US006623296B2

(12) United States Patent
Okamoto

(10) Patent No.: US 6,623,296 B2
(45) Date of Patent: Sep. 23, 2003

(54) PLUG SOCKET

(75) Inventor: Isao Okamoto, Moriguchi (JP)

(73) Assignee: Nichido Kogyo Kabushiki Kaisha, Osaka (JP)

( * ) Notice: Subject to any disclaimer, the term of this patent is extended or adjusted under 35 U.S.C. 154(b) by 0 days.

(21) Appl. No.: 10/137,367

(22) Filed: May 3, 2002

(65) Prior Publication Data

US 2002/0168902 A1 Nov. 14, 2002

(30) Foreign Application Priority Data

May 9, 2001 (JP) ..... 2001-138659

(51) Int. Cl.[7] ..... H01R 13/60
(52) U.S. Cl. ..... 439/536; 439/536; 439/535
(58) Field of Search ..... 439/536, 535, 439/651, 652

(56) References Cited

U.S. PATENT DOCUMENTS 4,725,249 A * 2/1988 Blackwood et al. ..... 439/535
4,756,695 A * 7/1988 Lane et al. ..... 439/535
5,117,122 A * 5/1992 Hogarth et al. ..... 439/535
5,558,536 A * 9/1996 Horton ..... 439/535
5,807,141 A * 9/1998 Sexton ..... 439/535

* cited by examiner

*Primary Examiner*—Gary Paumen
(74) *Attorney, Agent, or Firm*—McDermott, Will & Emery

(57) ABSTRACT

A plug socket includes an intermediate plug having an intermediate slit into which a terminal blade of an insertion plug is inserted and an intermediate terminal blade, a case part containing a main terminal blade-receiving element into which the intermediate terminal blade is inserted, and a mounting element for securing the case part onto a wall surface. The mounting element includes a recessed portion as a housing space for the intermediate plug, and a main slit is provided at the bottom face of the recessed portion for inserting the intermediate terminal blade. Accordingly, the intermediate plug arranged within the recessed portion is interposed to connect the insertion plug with the main terminal blade-receiving element. Therefore, such a socket can be provided that prevents breakage of the terminal blade-receiving element of the socket due to frequent insertion/removal of the insertion plug and allows for easy repair even if broken.

6 Claims, 9 Drawing Sheets

PLUG SOCKET

BACKGROUND OF THE INVENTION

1. Field of the Invention

The present invention relates to a plug socket installed on a wall surface of buildings or the like.

2. Description of the Background Art

FIG. 8 shows an exploded perspective view showing an exemplary, conventional plug socket structure. As shown in FIG. 8, a main case includes a case part 120 and a mounting element 130. The socket is formed of this main body case and a front cover 150. Case part 120 contains a terminal blade-receiving element 122 (see FIG. 10B) and a connection electrode portion (not shown) electrically connected to terminal blade-receiving element 122 to connect with an interior wiring for power supply. On the front face of case part 120, main slit 126 leading to terminal blade-receiving element 122 is provided.

Case part 120 is mounted onto a wall surface 10 of a building through mounting element 130 by means of a screw 162. Here, case part 120 is introduced into a socket-mounted hole 11 provided on wall surface 10 in advance and is then housed in wall surface 10. On the top, front cover 150 is mounted onto wall surface 10 by means of a screw 163 in order to avoid exposure of mounting element 130 on wall surface 10. Front cover 150 is provided with a plug-inserted opening 152 for exposing main slit 126 provided on the front surface of case part 120.

A terminal blade 71 of an insertion plug 70 of a power-supplied body, typically an electric appliance or the like is inserted into main slit 126 of the thus installed socket, so that the power-supplied body is powered through the plug socket.

The structure of the conventional socket will now be described. FIG. 9 is a perspective view showing the structure of case part 120 and mounting element 130 together forming the main body case. Here, case part 120 is shown mounted onto mounting element 130.

Case part 120 is formed of a rectangular parallelepiped shaped case 121 having a terminal blade-receiving face 125 on its front face, into which terminal blade 71 of insertion plug 70 is inserted. The side face of case 121 is provided with a protruding portion 124 for securing case part 120 to mounting element 130. Furthermore, plug-receiving face 125 described above is shaped such that it protrudes from the front face of case 121 by the thickness of a front cover plate 151 in order to be flush with front cover 150. In addition, at a prescribed location of plug-receiving face 125, there is formed main slit 126 into which the aforementioned terminal blade 71 of insertion plug 70 is inserted. Inside case part 120, there is arranged a leaf spring-shaped, main terminal blade-receiving element 122 electrically connected to terminal blade 71 of insertion plug 70 and rendered conductive. A main terminal blade-receiving portion 123 which is a receiving portion of main terminal blade-receiving element 122 is arranged to face the aforementioned main slit 126 (see FIG. 10B).

Now, mounting element 130 is formed of a plate 131 formed by press working and is provided at prescribed locations respectively with a latch portion 135 formed by folding back the plate and a threaded hole 136 for securing onto wall surface 10. Latch portion 135 is engaged with protruding portion 124 of case part 120 so that case part 120 is secured to mounting element 130.

A structure of a conductive portion in the conventional socket described above will now be described in detail. FIG. 10A is a front elevation showing the conventional socket attached onto the wall surface and FIG. 10B is a cross sectional view thereof taken along XB—XB.

As shown in FIG. 10A, at a prescribed location of front cover plate 151 of front cover 150, there is provided plug-inserted opening 152 for letting through plug-inserted face 125 formed on the front surface of case part 120. Therefore, plug-inserted face 125 is exposed to be flush with front cover plate 151. Furthermore, main terminal blade-receiving element 122 provided inside case part 120 is electrically connected with the interior wiring to enable power supply (see FIG. 10B). Main terminal blade-receiving portion 123 of main terminal blade-receiving element 122 is positioned to face toward main slit 126 so that terminal blade 71 of insertion plug 70 is brought into contact therewith and rendered conductive when inserted, thereby enabling power supply.

In the conventional socket, unfortunately, frequent insertion of the insertion plug by the user degrades and breaks the main terminal blade-receiving element for power supply. Using such a degraded or broken main terminal blade-receiving element without repair is very dangerous, may lead to an electric shock, and in addition may allegedly cause a fire resulting from abnormal heating by contact failures.

It is, however, not an easy task to determine externally whether the main terminal blade-receiving element is degraded since it is contained in the case part. Moreover, even if degradation is known, replacement is extremely dangerous for non-skilled people and therefore requires skilled experts. In addition, the structure of the conventional socket does not allow for replacement of only the main terminal blade-receiving element and thus requires replacement of the entire case part or the entire socket, which is costly. Furthermore, in the replacement work, a circuit breaker needs to be closed for safety of the workers, which is troublesome and time consuming.

SUMMARY OF THE INVENTION

An object of the present invention is therefore to provide a plug socket free from breakage of a main terminal blade-receiving element even with frequent insertion/removal of a plug, more particularly to provide a plug socket allowing for easy repair by ordinary people without special knowledge or technique.

The present invention provides a plug socket into which a terminal blade of an insertion plug is inserted frontward. The plug socket includes: an intermediate plug having an intermediate terminal blade-receiving element into which the terminal blade of the insertion plug is inserted and an intermediate terminal blade electrically connected to the intermediate terminal blade-receiving element; and a main case containing a main terminal blade-receiving element into which the intermediate terminal blade is inserted. The intermediate plug has an intermediate slit leading the intermediate terminal blade-receiving element at a front face. The main case includes a housing space having a front opening, formed with a front face and a recessed bottom face positioned to retreat backward from the front face and having a main slit leading to the main terminal blade-receiving element. The intermediate plug arranged in the housing space is interposed to connect the insertion plug with the main terminal blade-receiving element.

In this configuration, the terminal blade of the insertion plug is inserted into the intermediate terminal blade-receiving element of the intermediate plug, so that direction insertion/removal of the insertion plug into/from the main terminal blade-receiving element is eliminated, thereby preventing degradation or breakage of the main terminal blade-receiving element due to frequent insertion/removal of the terminal blade. In addition, a space for housing the intermediate plug is saved by arranging the main terminal blade-receiving element at a position recessed from the front face of the main case, so that the intermediate plug cannot be protruded from a wall surface.

Even when the terminal blade-receiving portion of the intermediate plug is broken by frequent insertion/removal of the terminal blade of the insertion plug, the entire socket needs not be replaced and only to be replaced is an intermediate plug. Furthermore, easy replacement of the intermediate plug eliminates the troublesome works conventionally required and also allows for repairs by ordinary people without special knowledge and technique. Moreover, a simple structure of the intermediate plug allows for relatively inexpensive manufacture and significantly reduces the repair cost. In addition, an electric shock or a fire due to contact failures or the like can be prevented before it happens by replacing the intermediate plug timely.

Preferably, in the plug socket in accordance with the present invention, the intermediate plug may further have an intermediate ground terminal-receiving element interposed to connect with a ground terminal and an intermediate ground terminal electrically connected with the intermediate ground terminal-receiving element. A front face of the intermediate plug may have an intermediate ground slit leading to the intermediate ground terminal-receiving element. The main case may further have a main ground slit on a recessed bottom face, into which the intermediate ground terminal is inserted.

With this configuration, it is possible to provide a plug socket adapted for an insertion plug with a ground terminal by providing the intermediate plug with an intermediate ground terminal interposed to connect with ground terminal.

Preferably, the plug socket in accordance with the present invention may further include a front cover covering the front opening of the housing space, and the front cover may have an opening exposing the front face of the intermediate plug.

With this configuration, the main case body and the intermediate plug are not exposed and the appearance of the plug socket is not impaired when installed on a wall surface. Furthermore, it is also effective that the structure inside the socket is hidden from view by the front cover so as not to expose on a wall surface for safety. It is noted that the front cover must have an opening allowing the terminal blade of the insertion plug to be inserted through the intermediate slit provided on the front face of the intermediate plug.

Preferably, in the plug socket in accordance with the present invention, the front face of the front cover may be positioned to be coplanar with the front face of the intermediate plug.

With this configuration, the front face of the plug socket is flat so that the appearance is further improved.

Preferably, in the plug socket in accordance with the present invention, an abutment portion may be provided between the front cover and the intermediate plug to bring about abutment against each other for preventing the intermediate plug from dropping-off forward.

In this configuration, the front cover abuts against the intermediate plug, so that the intermediate plug is surely secured within the housing space. Therefore, the intermediate plug can be prevented from dropping-off forward due to frequent insertion/removal of the insertion plug.

Preferably, in the plug socket in accordance with the present invention, an engagement portion may be provided between the intermediate plug and the main case to bring about engagement with each other so that the intermediate plug is guided forward and backward and secured within the housing space.

In this configuration, the intermediate plug is guided by the engagement portion, so that even ordinary people without special knowledge and technique can secure the intermediate plug within the housing space easily and repair reliably. Furthermore, this engagement portion can also function to align the intermediate plug and effectively prevent the intermediate plug from being inserted in the wrong direction.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the followings, embodiments of the present invention will be described with reference to the figures.

(First Embodiment)

Figure 1:
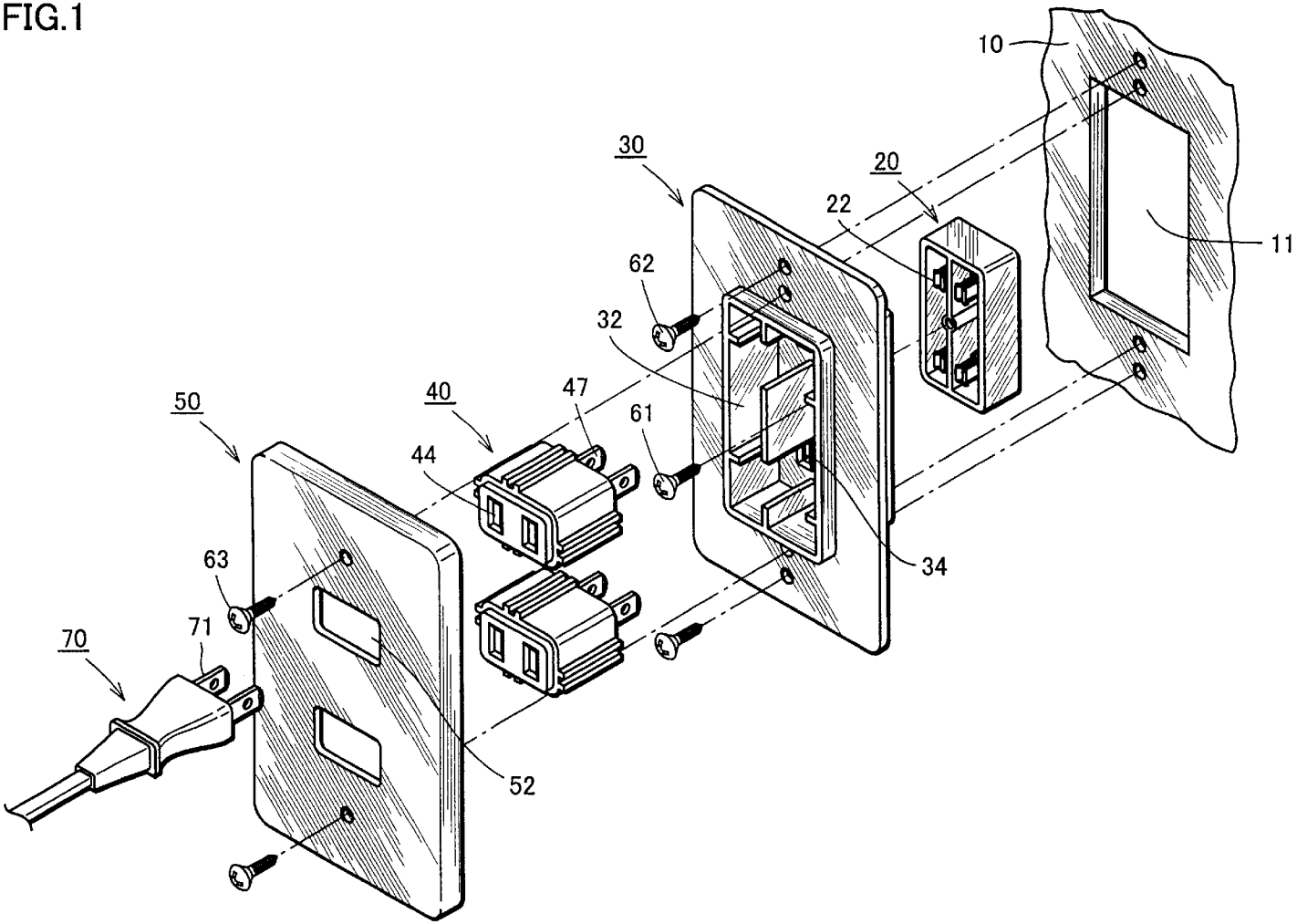
FIG. 1 is an exploded perspective view showing a structure of a socket in accordance with a first embodiment of the present invention.

As shown in FIG. 1, a plug socket in accordance with the first embodiment of the present invention includes a main case, an intermediate plug 40 and a front cover 50. The main case includes a case part 20 and a mounting element 30. Case part 20 contains a main terminal blade-receiving element 22 for power supply and a connection electrode portion (not shown) electrically connected with main terminal blade-receiving element 22 to connect with an interior wiring for power supply. Case part 20 is secured to mounting element 30 by a screw 61 and at the same time secured to a wall surface 10 with mounting element 30 being secured onto wall surface 10 using a screw 62. Here, case part 20 is not exposed outside on wall surface 10 since it is introduced and housed in a socket-mounted hole 11 provided in advance on wall surface 10 of a building.

An intermediate plug 40 provided to intervene between main terminal blade-receiving element 22 of case part 20 and an insertion plug 70 is introduced into a recessed portion 32 provided on the front face of mounting element 30. Intermediate plug 40 includes an intermediate electrode portion 46 including an intermediate terminal blade-receiving portion 48 as an intermediate terminal blade-receiving element and an intermediate terminal blade 47 (see FIGS. 4A and 4B). On the top, front cover 50 is secured onto wall surface 10 by means of a screw 63 to secure intermediate plug 40 as well as to cover and hide mounting element 30. Front cover 50 is provided with a plug-inserted opening 52 for exposing an intermediate slit 44 provided on the front face of intermediate plug 40.

Insertion plug 70 is inserted in the socket thus installed so that the power-supplied body is powered through the socket.

Figure 2:
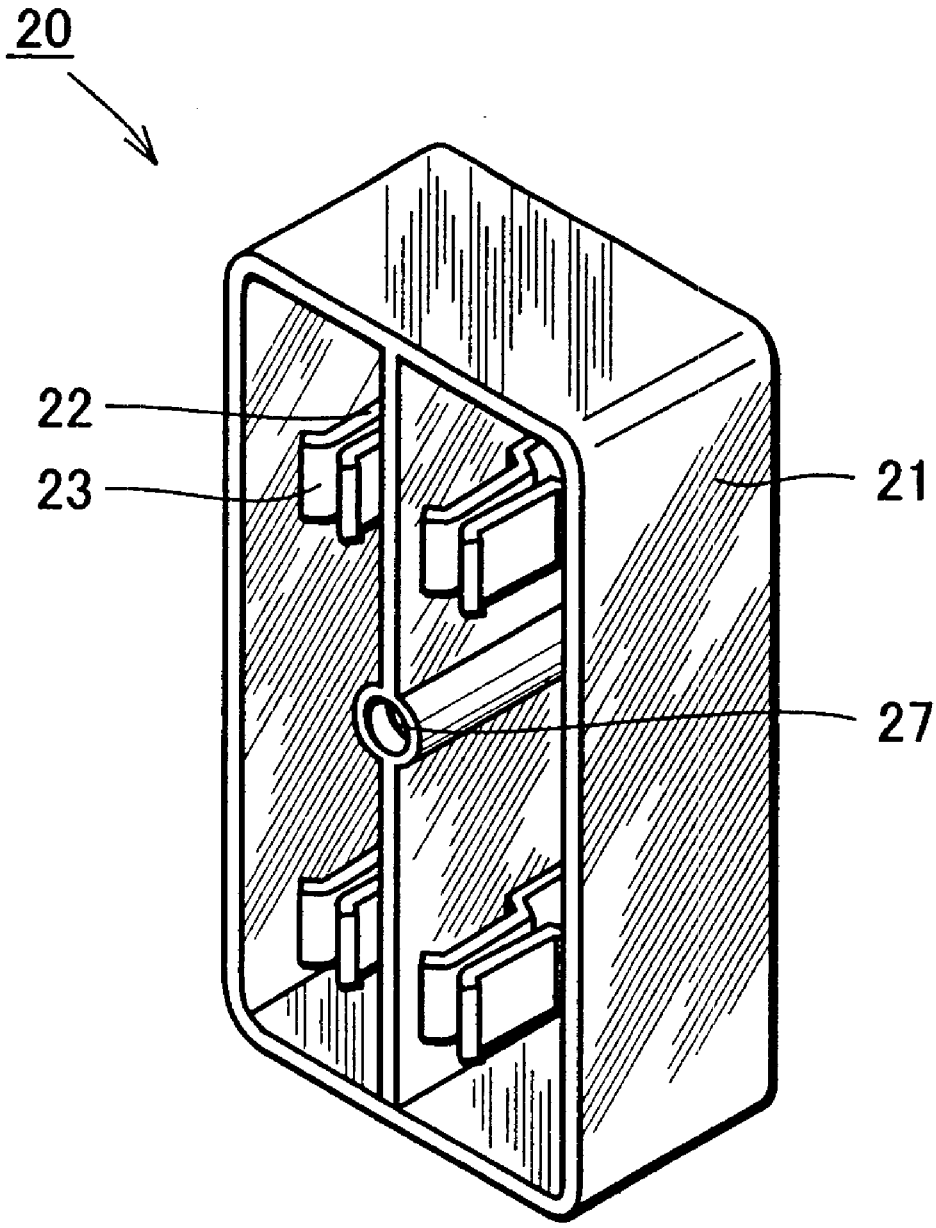
FIG. 2 is a perspective view illustrating a structure of a case part in accordance with the first embodiment of the present invention.

The structure of each portion forming the socket will now be described. First, referring to FIG. 2, the structure of the case part will be described. As shown in FIG. 2, case part 20 in this embodiment is formed of a box-shaped case 21 with an opening only on the front face, and a main terminal blade-receiving element 22 for power supply is provided therein. Preferably, case 21 is molded from a fireproof resin material in view of safety. Main terminal blade-receiving element 22 has a shape of a leaf spring, the middle of which is folded to form a main terminal blade-receiving portion 23. Main terminal blade-receiving portion 23 has such a structure in that the inserted terminal blade is sandwiched and fixed with both ends, and the terminal blade can be attached and detached by insertion/removal with at least a certain force. Furthermore, at the center of case 21, a threaded hole 27 for use in securing case part 20 to mounting element 30 is provided.

Figure 3:
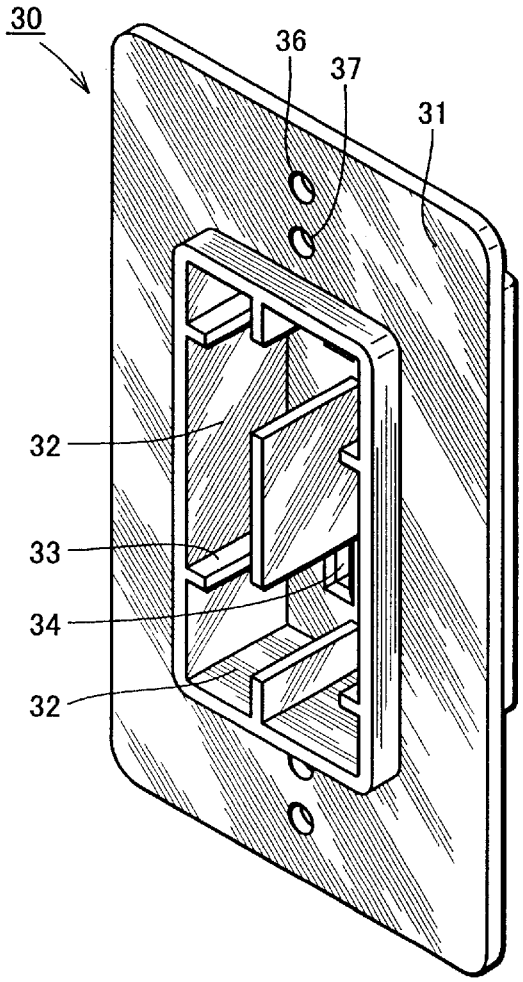
FIG. 3 is a perspective view illustrating a structure of a mounting element in accordance with the first embodiment of the present invention.

Next, the structure of the mounting element will be described. As shown in FIG. 3, mounting element 30 includes a plate 31 to be mounted on wall surface 10 and a recessed portion 32 formed toward the backside at the center portion thereof. Preferably, mounting element 30 is molded from a fireproof resin material as a whole in view of safety. A threaded hole 36 for securing mounting element 30 on wall surface 10 and a threaded hole 37 for mounting front cover 50 are respectively provided at prescribed locations of plate 31. Furthermore, at the center of the bottom surface of recessed portion 32, a threaded hole 35 (not shown) for securing mounting element 30 and case part 20 is provided.

On the side and bottom surfaces of recessed portion 32, a plurality of protruding portions 33 of engagement portions that guides forward and backward and secures intermediate plug 40 in an alignment manner are provided to project inwardly of recessed portion 32. On the bottom face of recessed portion 32, main slit 34 is also formed to allow terminal blade 47 of intermediate plug 40 to be introduced. Main slit 34 is provided such that main terminal blade-receiving portion 23 is positioned to face toward main slit 34 after case portion 20 and mounting element 30 are attached.

Figure 4A:
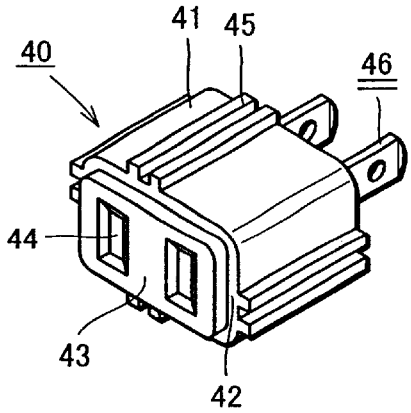
FIG. 4A is a perspective view illustrating a structure of an intermediate plug in accordance with the first embodiment of the present invention and FIG. 4B is a perspective view illustrating a structure of an intermediate electrode portion of a main structural component of the intermediate plug.

Now, the structures of the intermediate plug and the intermediate electrode portion as the main structural component thereof will be described. Referring to FIG. 4A, intermediate plug 40 is formed of an intermediate electrode portion supporting body 41 and an intermediate electrode portion 46. Intermediate electrode portion supporting body 41 is preferably molded from a fireproof resin material in order to ensure insulation and safety, as in the aforementioned case part 20 and mounting element 30. On the front face of intermediate electrode portion supporting body 41, an intermediate slit 44 receiving terminal blade 71 of insertion plug 71 is formed. Furthermore, at the periphery of this front face, there is formed an abutment portion 42 abutting against front cover 50 so that intermediate plug 40 is secured within recessed portion 32 provided at mounting element 30. In addition, on the side face of intermediate electrode portion supporting body 41, a plurality of guide channels that are engagement portions for aligning and securing intermediate plug 40. Furthermore, intermediate terminal blade 47 of intermediate electrode portion 46 protrudes on the back face.

Figure 4B:
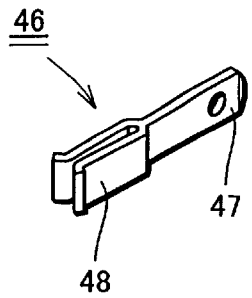

On the other hand, intermediate electrode portion 46 has the aforementioned terminal blade 47 on one end and an intermediate terminal blade-receiving portion 48 for receiving terminal blade 71 of insertion plug 70 on the other end, as shown in FIG. 4B. Intermediate terminal blade-receiving portion 48 has a shape similar to the main terminal blade-receiving portion 23 described above and allows the terminal blade to be attached/detached by insertion/removable with at least a certain force. Intermediate terminal blade-receiving portion 48 is arranged to face toward intermediate slit 44 provided on the front surface of the aforementioned intermediate electrode portion supporting body 44.

Figure 5:
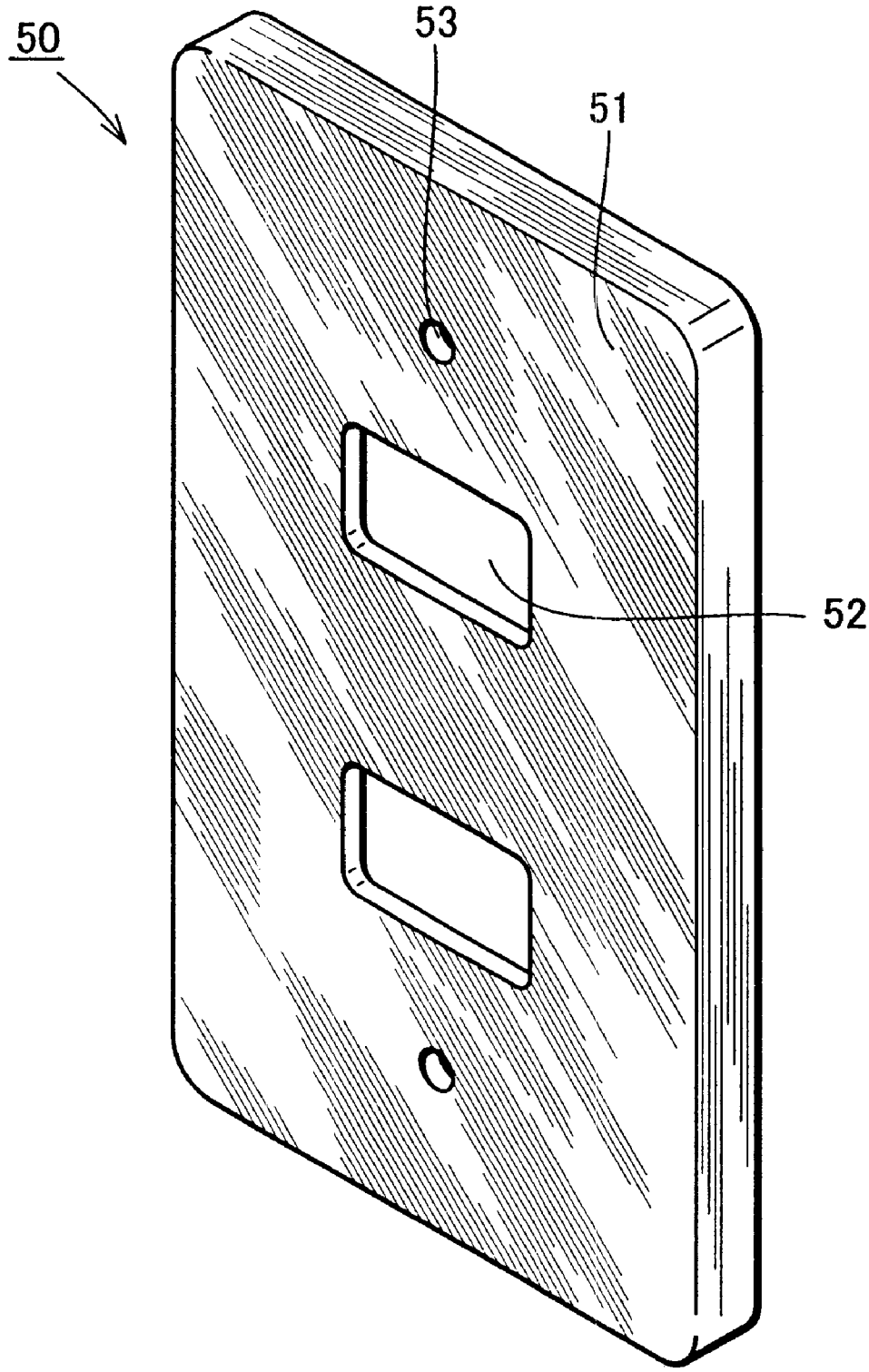
FIG. 5 is a perspective view illustrating a structure of a front cover in accordance with the first embodiment of the present invention.

The structure of the front cover will now be described. As shown in FIG. 5, front cover 50 includes a plug-inserted opening 52 for inserting terminal blade 71 of insertion plug 70 and a threaded hole 53 for securing front cover 50, respectively at prescribed locations of front cover plate 51 of an exterior face. Preferably, the front cover is also formed of a fireproof resin material for safety.

Figure 6B:
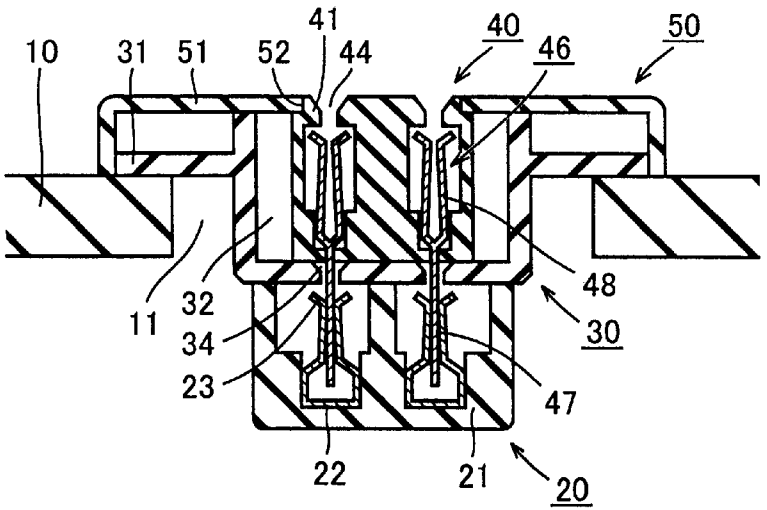
FIG. 6A is a front elevation of the socket mounted onto a wall surface in accordance with the first embodiment of the present invention and FIG. 6B is a cross sectional view of FIG. 6A taken along VIB—VIB.
Figure 6A:
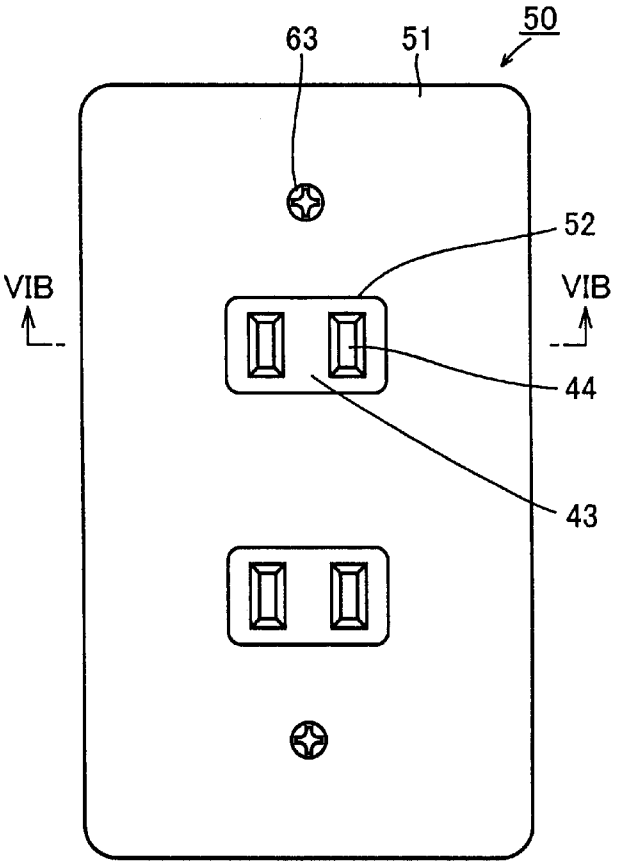

Now, the structure of the socket mounted on the wall surface in accordance with the present embodiment as described above will be described. As shown in FIG. 6A, plug-receiving face 43 of intermediate plug 40 is exposed through plug-inserted opening 52 provided on front cover plate 51 of front cover 50 and is flush with front cover 50. Main terminal blade-receiving element 22 provided inside case part 20 is electrically connected to an interior wiring and ready for power supply (see FIG. 6B). When intermediate plug 40 is inserted into recessed portion 32 of mounting element 30, intermediate terminal blade 47 of intermediate electrode portion 46 is introduced into main terminal blade-receiving portion 23 of main terminal blade-receiving element 22 to come into contact with each other for electrical connection. Intermediate terminal blade-receiving portion 48 formed on the other end of intermediate electrode portion 46 is positioned to face toward intermediate slit 44 positioned on the front face of intermediate plug 40, so that when terminal blade 71 of insertion plug 70 is inserted they are brought into contact with each other and rendered conductive, thereby allowing power supply.

With use of the socket in this embodiment as describe above, terminal blade 71 of insertion plug 70 is inserted into intermediate terminal blade-receiving portion 48 of intermediate plug 40, so that the breakage of main terminal blade-receiving element 22 of case part 20 can be prevented.

Furthermore, even if intermediate terminal blade-receiving portion 48 of intermediate plug 40 is broken by inserting and removing terminal blade 71 of the insertion plug, the repair is completed simply by replacing intermediate plug 40. Therefore, as compared with the breakage of the main terminal blade-receiving element in the conventional socket, repair time is significantly reduced, repair works become easy, and even ordinary people without expert knowledge can repair. Furthermore, since replacement of case part 20 is not necessary, the circuit breaker needs not be closed, thereby avoiding cumbersome works. Additionally, when the conventional socket is replaced with the socket of this invention, the socket-mounted hole provided on the wall surface needs not be enlarged, thereby facilitating the replacement, because they are designed to be equal in size.

As an additional effect, since intermediate plug 40 has a simple structure and a small size as compared with case part 20, the cost thereof can be kept low and therefore the repair cost can be reduced. Furthermore, the breakage of intermediate terminal blade-receiving portion 48 can be prevented by replacing intermediate plug 40 before it happens, thereby leading to prevention of a fire and an electric shock due to contact failures.

(Second Embodiment)

Figure 7:
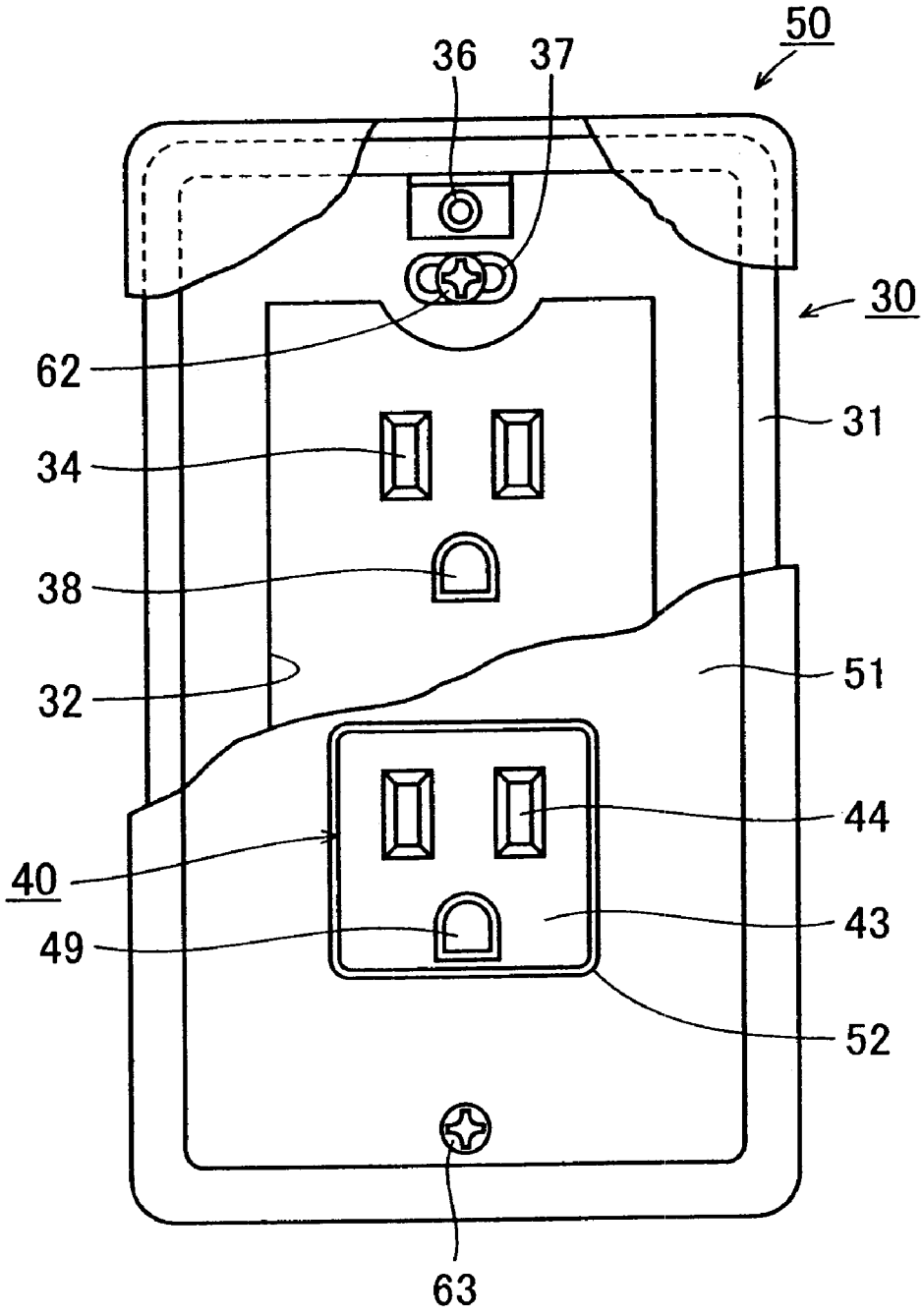
FIG. 7 is a front elevation of the socket partially cut away in accordance with a second embodiment of the present invention.
Figure 8:
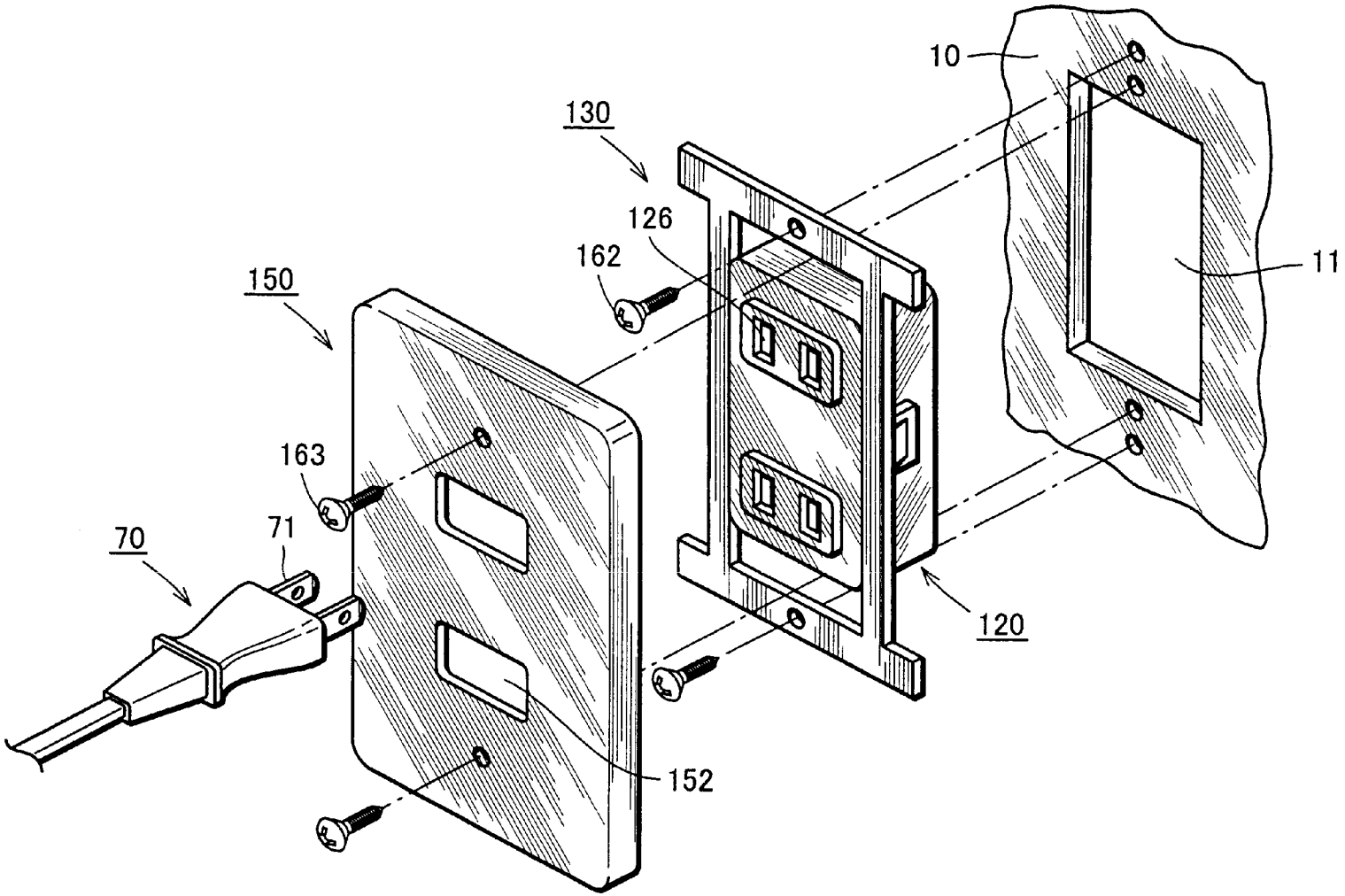
FIG.8 PRIOR ART
FIG. 8 is an exploded perspective view showing an exemplary structure of a conventional socket.
Figure 9:
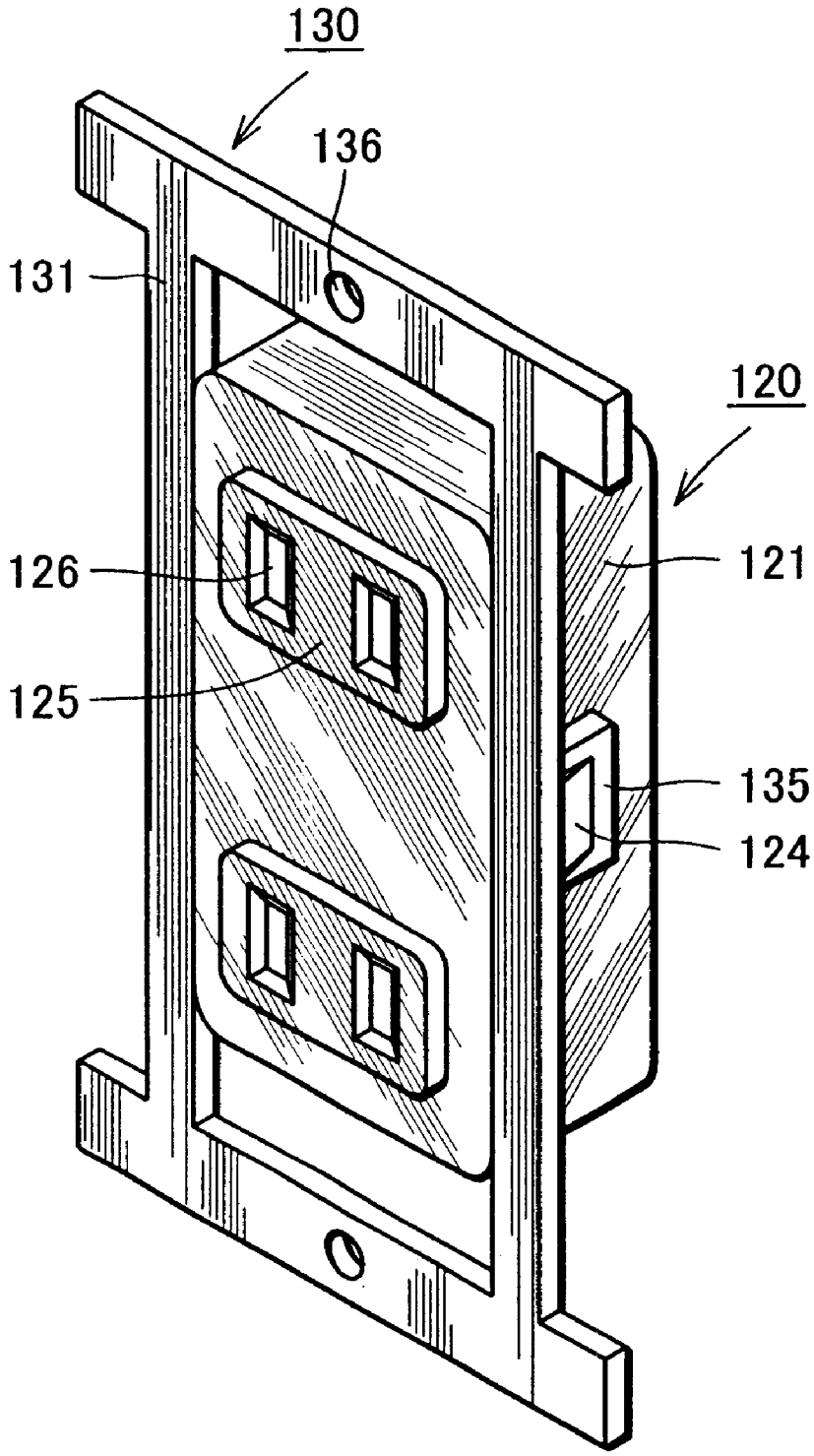
FIG.9 PRIOR ART
FIG. 9 is a perspective view showing the structure of a case part and a mounting element of the conventional socket.
Figure 10B:
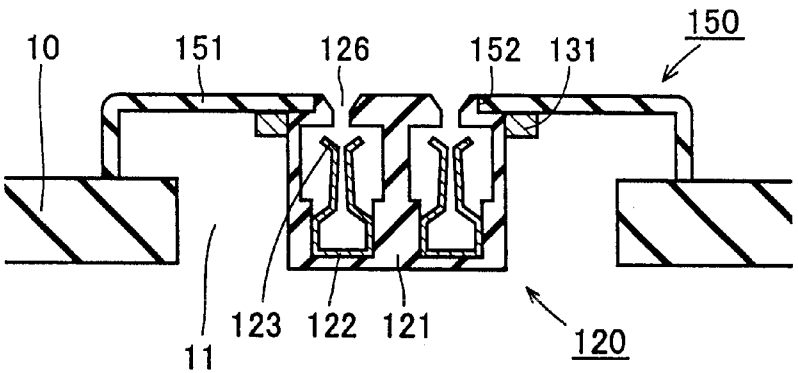
FIG.10B PRIOR ART
FIG. 10A is a front elevation of the conventional socket mounted onto a wall surface and FIG. 10B is a cross sectional view of FIG. 10A taken along XB—XB.
Figure 10A:
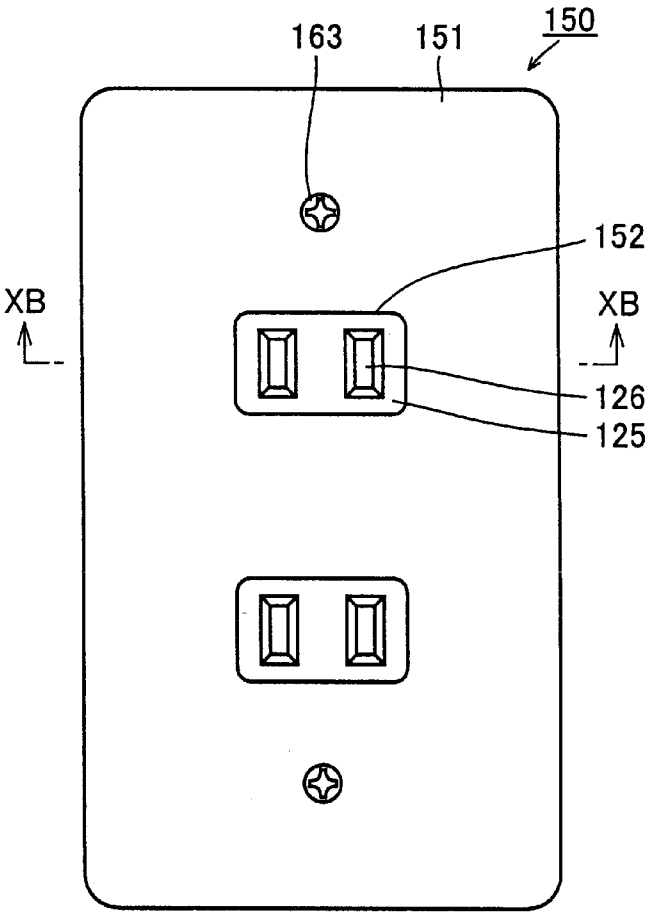
FIG.10A PRIOR ART

Referring to FIG. 7, the plug socket in accordance with a second embodiment of the present invention will be described. The socket in this embodiment is an improved version of the above first embodiment so as to correspond to an insertion plug having a ground terminal in addition to a terminal blade for power supply. Therefore, the same part as in the above first embodiment will be denoted with the same reference sign in the figure and description thereof will not be repeated.

As shown in FIG. 7, at a prescribe location of plate 31 of mounting element 30, a threaded hole 37 for attaching mounting element 30 onto the wall surface is provided. Mounting element 30 is secured on the wall surface by screw 62 through threaded hole 37. The main slit 34 receiving the intermediate terminal blade of intermediate plug 40 and a main ground slit 38 receiving an intermediate ground terminal are provided on the bottom face of recessed portion 32 that retreats backward of mounting element 30.

Intermediate plug 40 is housed in the above-noted recessed portion 32. Intermediate plug 40 is formed of an intermediate electrode portion supporting body and an intermediate electrode portion. The intermediate electrode portion includes an intermediate terminal blade for power supply and an intermediate ground terminal. In addition, plug-receiving face 43 of the intermediate plug is provided with an intermediate slit 44 leading to an intermediate terminal blade-receiving portion for the intermediate terminal blade and an intermediate ground slit 49 leading to an intermediate ground terminal-receiving portion for the intermediate ground terminal.

With intermediate plug 40 being housed, on the top, front cover 50 is further mounted. At a prescribed location of front cover plate 51 of front cover 50, a plug-inserted opening 52 is provided for exposing plug-receiving face 43 of intermediate plug 40 described above. Furthermore, front cover 50 has a threaded hole at a prescribed location and is secured on the wall surface by a screw 63 through this threaded hole.

With the configuration above, it is possible to provide a plug socket adapted for an insertion plug with a ground terminal.

In the forgoing embodiments, although an interior socket for home use has been illustrated and described, the present invention may not be limited thereto and may be applied to any socket as long as it is installed in a building to apply power to a power-supplied body, such as one for use in factories, the outdoors or the like. Furthermore, the present invention may not be limited to the one installed in buildings and may be applied to a table tap or a cord reel or the like.

Furthermore, although, in the embodiments above, the present invention is applied to a plug socket having two receptacles which allows insertion of two insertion plugs, the number of insertion plugs to be inserted may not be limited and any number can be employed. Obviously, the present invention may be applied to such a socket that is formed in combination with an interior light switch or an insertion terminal for a television antenna or the like.

Furthermore, although, in the embodiments above, a socket for two-phase alternating power supply is described by way of illustration, the present invention may also be applied to the one for three phase or direct current power supply or the like. In addition to a 100V socket, a socket for any voltage, 200V, 300V etc. may be adopted.

In the embodiments above, description has been made by way of illustration to a socket in which a case part and a mounting element are separately and independently manufactured and secured together by means of a screw to be an integral main case. Alternatively, they may originally be molded integrally.

Furthermore, although, in the socket in the embodiments above, the case part has been described by way of illustration as being box-shaped with an opening on the front face and being secured to the back side of the bottom face of the recessed portion of the mounting element, the present invention may not be limited thereto specifically. For example, the conventional case part may be used as it is by providing an opening having a prescribed size on the bottom face of the mounting element and providing a latch portion similar to the conventional mounting element at a prescribed location of the back side of the bottom face of this recessed portion. In this way, as the conventional case part is compatibly mounted, more inexpensive installation is possible not only when a new socket is installed but also when a part of the existing socket is utilized.

Furthermore, although, in the socket in the embodiments above, the protruding portion and the guide channel as engagement portions provided between the intermediate plug and the main case are structured to allow guiding and securing in four directions, up and down as well as leftward and rightward, they may be provided as necessary and may not be limited specifically.

Furthermore, although, in the embodiments above, all the components except for the conductive part and the screw are formed of a fireproof resin material in view of safety in any possible fire, the present invention may not be limited thereto and may employ any material as long as it is an insulating material.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A plug socket into which a terminal blade of an insertion plug is inserted frontward, comprising:

an intermediate plug having an intermediate terminal blade-receiving element into which the terminal blade of said insertion plug is inserted and an intermediate terminal blade electrically connected with the intermediate terminal blade-receiving element; and a main case containing a main terminal blade-receiving element into which said intermediate terminal blade is inserted, wherein said intermediate plug has an intermediate slit leading to said intermediate terminal blade-receiving element at a front face, said main case includes a housing space with a front opening, formed with a front face and a recessed bottom face positioned to retreat backward from the front face and having a main slit leading to said main terminal blade-receiving element, and said intermediate plug arranged in said housing space is interposed to connect said insertion plug with said main terminal blade-receiving element.

2. The plug socket according to claim 1, wherein said intermediate plug further has an intermediate ground terminal-receiving element interposed to connect with a ground terminal and an intermediate ground terminal electrically connected with the intermediate ground terminal-receiving element, said front face of said intermediate plug has an intermediate ground slit leading to said intermediate ground terminal-receiving element, and said main case further has a main ground slit on the recessed bottom face, into which said intermediate ground terminal is inserted.

3. The plug socket according to claim 1, further comprising a front cover covering the front opening of said housing space, wherein said front cover has an opening exposing the front face of said intermediate plug.

4. The plug socket according to claim 3, wherein a front face of said front cover is positioned to be coplanar with the front face of said intermediate plug.

5. The plug socket according to claim 3, wherein an abutment portion is provided between said front cover and said intermediate plug to bring about abutment against each other for preventing said intermediate plug from dropping-off forward.

6. The plug socket according to claim 1, wherein an engagement portion is provided between said intermediate plug and said main case to bring about engagement with each other so that said intermediate plug is guided forward and backward and secured within said housing space.

* * * * *